US006351950B1

(12) United States Patent
Duncan

(10) Patent No.: US 6,351,950 B1
(45) Date of Patent: Mar. 5, 2002

(54) REFRIGERATION SYSTEM WITH VARIABLE SUB-COOLING

(75) Inventor: Gerald David Duncan, Auckland (NZ)

(73) Assignee: Fisher & Paykel Limited, Auckland (NL)

( * ) Notice: Subject to any disclaimer, the term of this patent is extended or adjusted under 35 U.S.C. 154(b) by 0 days.

(21) Appl. No.: 09/486,788

(22) PCT Filed: Sep. 3, 1998

(86) PCT No.: PCT/NZ98/00132

§ 371 Date: May 8, 2000

§ 102(e) Date: May 8, 2000

(87) PCT Pub. No.: WO99/13277

PCT Pub. Date: Mar. 18, 1999

(30) Foreign Application Priority Data

Sep. 5, 1997 (NZ) ..... NZ328684

(51) Int. Cl.[7] ..... F25B 21/02; F25B 41/00

(52) U.S. Cl. ..... 62/3.2; 62/279; 62/511; 62/513

(58) Field of Search ..... 62/513, 3.2, 511, 62/527, 279

(56) References Cited

U.S. PATENT DOCUMENTS

| | | | | | |
|---|---|---|---|---|---|
| 4,147,037 | A | * | 4/1979 | Gelbard et al. | 62/513 X |
| 4,208,886 | A | | 6/1980 | Maudin | 62/498 |
| 4,316,366 | A | * | 2/1982 | Manning | 62/513 X |
| 4,423,602 | A | | 1/1984 | Vanable | 62/238.6 |
| 4,696,168 | A | | 9/1987 | Woods et al. | 62/200 |
| 5,205,131 | A | | 4/1993 | Powlas | 62/203 |

FOREIGN PATENT DOCUMENTS

| | | |
|---|---|---|
| EP | 0208526 | 1/1987 |
| EP | 0255035 | 2/1988 |

* cited by examiner

*Primary Examiner*—William Wayner
(74) *Attorney, Agent, or Firm*—Trexler, Bushnell, Giangiorgi, Blackstone & Marr, Ltd

(57) ABSTRACT

A vapor compression refrigeration system using a capillary as an expansion device has a liquid refrigerant subcooler between a condenser and the capillary which is controlled to vary the refrigerant flow.

11 Claims, 5 Drawing Sheets

REFRIGERATION SYSTEM WITH VARIABLE SUB-COOLING

TECHNICAL FIELD

This invention relates to refrigeration systems and in particular to refrigeration systems used in household refrigerators. It is particularly but not solely applicable to refrigeration systems incorporating variable capacity compressors.

BACKGROUND ART

Vapour compression refrigeration systems utilise the large quantity of heat absorbed in a liquid refrigerant as it vaporises to extract heat from an enclosed space. This heat is subsequently released to the environment when the vapour is recondensed. The system operates in a closed cycle as shown in FIG. 1. First the refrigerant is vaporised in a heat exchanger situated inside the enclosed space to be cooled. The vapour is then compressed and transported to an external heat exchanger where the refrigerant condenses at a high pressure, releasing the previously absorbed heat to the environment. The heat exchangers are called the evaporator and condenser respectively. The liquid refrigerant is then returned to the evaporator via a flow control device A. In this case a capillary tube is used. A capillary to suction line heat exchanger B is optional and is commonly used to improve the overall efficiency of the system by increasing the enthalpy of vaporisation of the refrigerant. This effect is shown in FIG. 2 where the cycle without capillary to suction line heat exchange is shown by the cycle 1'-2'-3-5'-6 and that with is 1-2-3-4-5-6. In this case the heat exchanger is at or near the entrance of the capillary for clarity. The reference numerals 1 to 6 in FIG. 2 correspond to the positions 1 to 6 in FIG. 1 around the cycle. The enthalpy of vaporisation is measured by the change in enthalpy between points 5' to 6 and 5 to 6 respectively. Greater separation indicates a greater change in enthalpy as the refrigerant vaporises.

The function of any flow control is two fold (1) to meter the liquid refrigerant from the liquid line into the evaporator at a rate commensurate with the rate at which vaporisation is occurring and (2) to maintain a pressure differential between the high and low pressure sides of the system in order to permit the refrigerant to vaporise under the desired low pressure in the evaporator while at the same time condensing at a high pressure in the condenser.

The capillary tube is the simplest of the refrigerant flow controls, consisting of a fixed length of small diameter tubing connected between the condenser and the evaporator. It is the device normally applied in small refrigerating systems. Because of the high frictional resistance resulting from its length and small bore and because of the throttling effect resulting from the gradual formation of vapour in the tube as the pressure of the liquid is reduced below its saturation pressure, the capillary tube acts to restrict the flow of liquid from the condenser to the evaporator and also to maintain the required operating pressure differential.

For any given tube length and bore the flow resistance of the tube is fixed, so the liquid flow rate through the tube is proportional to the pressure differential across the tube. Since the capillary tube and the compressor are in series, if the system is to perform efficiently the flow capacity of the tube must be chosen such that it matches the pumping capacity of the compressor at the system design pressures.

The system pressures are dependent on both the temperature of the environment and the enclosed space. At temperatures other than those which correspond to the design pressures, a mismatch will typically occur between the capillary and the compressor and the efficiency of the system will be less than maximum.

The efficiency of the system is also influenced by variation of the rate of heat required to be removed from the enclosed space. Variation can occur for instance because of door openings allowing warm air and environmental temperature changes. In vapour compression systems the rate of heat removal is proportional to the mass flow rate of the refrigerant. The essentially constant resistance to liquid flow of the capillary tube prevents any significant variation of flow rate under these conditions. Conventional refrigeration compressors are effectively constant pumping capacity devices. They address the need to vary flow rate by cycling on and off. By varying the cycling duty ratio they are effectively able to vary the rate of heat flow.

Cycling the compressor introduces other sources of system inefficiency. For instance the pressure differential is lost when the compressor is off and additional work is required to re-establish pressures at turn on. Also the condenser and evaporator heat exchangers are operated at less than optimum efficiency when the compressor is cycled.

Despite its limitations, its benefits which include cost and simplicity still make the capillary tube the flow control of choice in small refrigerating systems.

In order to eliminate loss of system efficiency due to cycling, variable capacity compressors have been developed. When used in conjunction with capillary tubes system efficiency gains can be obtained. However because of the fixed flow resistance the other limitations still limit efficiency.

DISCLOSURE OF THE INVENTION

It is therefor an object of the invention to provide a refrigeration system and/or method which will at least go some way toward overcoming the aforementioned disadvantages or which will at least provide the public with a useful choice.

In one aspect the invention consists in a refrigeration system comprising:

a compressor, a condensor, a flow control device, and an evaporator, all connected in refrigerant flow relation such that the refrigerant flows through the system to absorb heat at the evaporator, said flow control device comprising a capillary tube wherein in use refrigerant from said condensor enters said tube in a substantially liquid state and exits said tube in a mixed fluid/vapour state, there being a flash point in said tube at which said liquid begins to vaporize, and variable sub-cooling means to provide additional forced cooling of the refrigerant at a region of or just prior to said capillary, said sub-cooling means variable to control the degree of said sub-cooling of the refrigerant, and thereby to control the position along said capillary at which the refrigerant reaches saturation pressure, to provide a flow control which is variable to match the system and conditions under which it operates.

Preferably said compressor is variable speed to provide varying flow capacities depending on the circumstance and said variable sub-cooling means are variable such that the flow control provided by said expansion valve matches said varied compressor.

Preferably said sub-cooling means comprises one or more thermoelectric elements in intimate thermal connection with said capillary.

Preferably said refrigeration system includes environment reactive means which are adapted to affect the degree of sub-cooling of said sub-cooling means in accordance with external environmental factors such as ambient temperature and humidity.

Preferably said refrigeration system includes optimisation means that in conjunction with said environment reactive means and with a said variable compressor varies the degree of sub-cooling and the operating capacity of said variable capacity compressor to optimise the efficiency of said refrigeration system having regard to external environmental factors and/or user usage patterns and/or monitored temperature characteristics within said refrigerator.

In a further aspect the invention consists in a method of refrigerating comprising passing a refrigerant through a refrigeration system including a condenser, a capillary flow control device and an evaporator connected in refrigerant flow relation to absorb heat at said evaporator and give off heat at said condenser, which method includes the steps of assessing one or more environmental or usage factors affecting the performance of said refrigeration system and sub-cooling said refrigerant at the entry to or along the length of said capillary flow control device to a degree varied according to said assessed factor or factors.

Preferably said method includes the step of varying the mass flow of refrigerant through said system in accordance with one or more said factors.

In a still further aspect the invention consists in a refrigerator incorporating a refrigeration system or method in accordance with any one of the above paragraphs.

In a yet further aspect the invention consists in a refrigeration system substantially as herein described with reference to FIGS. 3 to 7.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The preferred embodiment of the present invention will now be described with reference to the accompanying drawings in which.

BEST MODES FOR CARRYING OUT THE INVENTION

Figure 3:
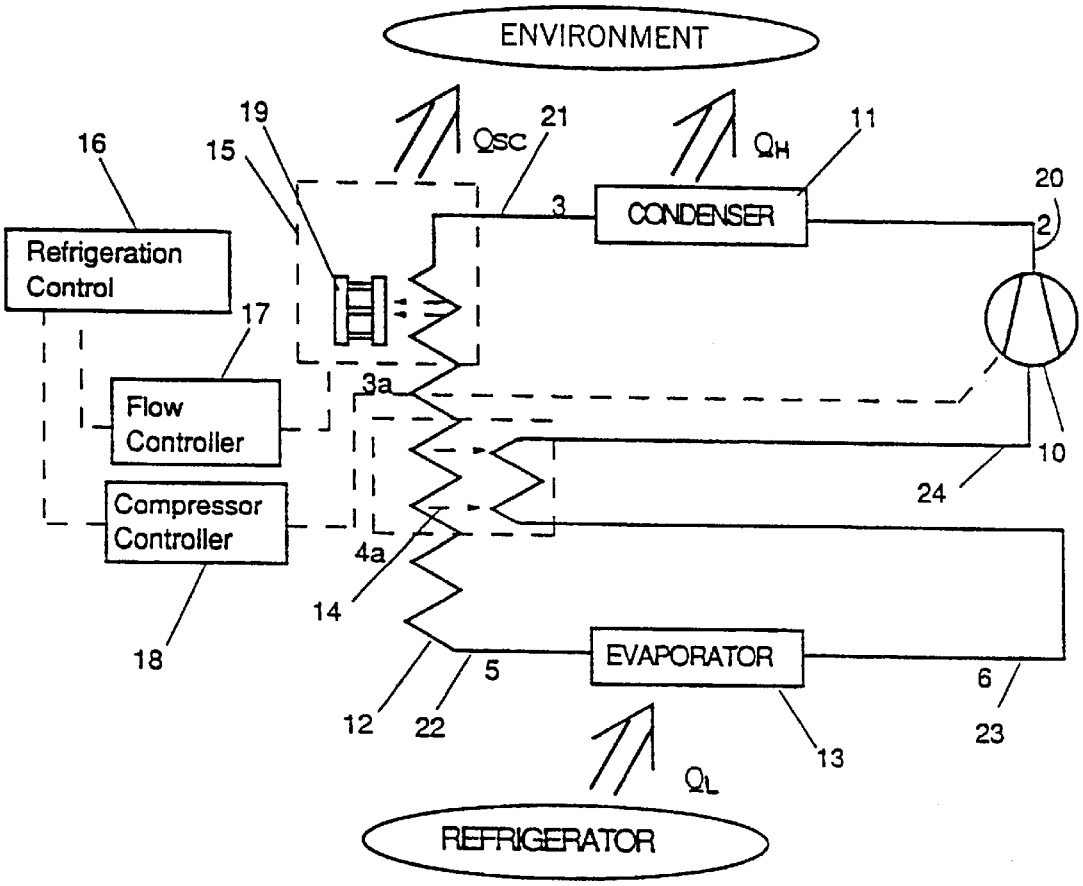
FIG. 3 is a schematic of a vapour compression refrigeration cycle according to the preferred embodiment of the present invention.

Referring to FIG. 3 a refrigeration system according to the preferred embodiment of the present invention is shown having a compressor 10, a condenser 11 connected to the outlet of the compressor 10 by a conduit 20, capillary 12 connected to the outlet of the condenser by conduit 21 and an evaporator 13 connected to the outlet of capillary 12 by conduit 22. A return conduit 23, 24 is provided from the evaporator 13 to the compressor 10, and this return conduit may include for improved efficiency passing the refrigerant through capillary to suction line heat exchanger 14 in a manner well known in the prior art.

Figure 1:
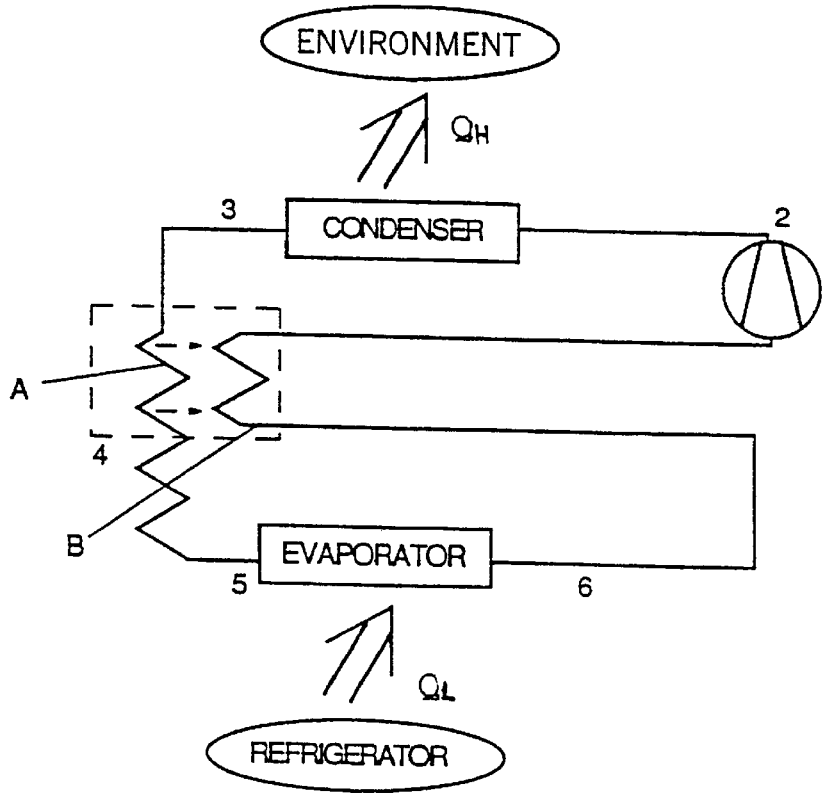
FIG. 1 is a typical schematic of a small vapour compression refrigeration system of the prior art.
Figure 2:
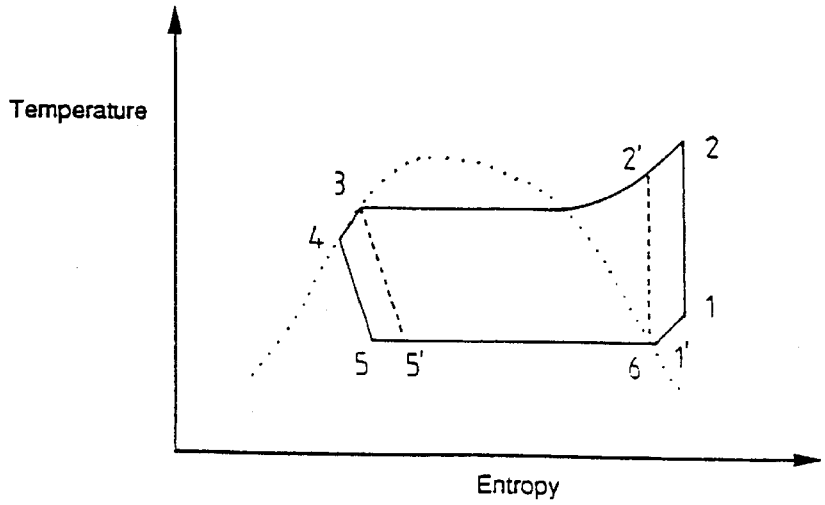
FIG. 2 is a temperature-entropy diagram of a typical small vapour compression refrigeration cycle such as performed by the system of FIG. 1.

As with the prior art refrigeration system shown in FIG. 1 $Q_H$ is given off at the condenser where the compressed refrigerant is at a high temperature relative to the environment, and heat $Q_L$ is absorbed at the evaporator where the refrigerant is at low pressure and temperature.

The refrigeration system of the present invention is characterised by the inclusion of a variable sub-cooling means 15 provided at the entrance to or along the capillary flow control device 12, which provides additional forced cooling of the refrigerant at or just prior to the capillary 12 and as will be described later enables the capillary 12 to function as a variable flow control. The variable sub-cooling means 15 of the present invention may for example comprise a thermoelectric element in physical contact with the capillary 12 adjacent the inlet thereof, such that voltage applied to the thermoelectric element 19 in the usual manner will cause a temperature differential across the thermoelectric element instigating a flow of heat $Q_{SC}$ from the refrigerant flowing through the capillary, to thereby sub-cool the refrigerant entering the capillary. A flow controller 17 is provided to modulate the power provided to thermoelectric element 19 to thereby control the amount of heat $Q_{SC}$ extracted from the capillary to control the degree of sub-cooling of the refrigerant at entry to the capillary 12.

In a preferred form of the invention the compressor 10 is a variable capacity compressor capable of operating at a controlled pumping rate. In such instance a compressor controller 18 controls the capacity of the compressor 10 in accordance with instructions received from a refrigeration control 16. Refrigeration control 16 also preferably controls the operation of flow controller 17. Refrigeration control 16 may control the flow controller 17 and compressor controller 18 in a manner to provide refrigeration performance in accordance with user desired temperature characteristics, usage patterns and environmental variables, and by varying the sub-cooling achieved by the thermoelectric element 19 via the flow controller 17 may vary the flow control provided by capillary 12 to match the other system and environment parameters.

It will be appreciated that the variable flow control provided by the present invention is also applicable to systems not having a variable capacity compressor in which instance the variable flow control may be used to compensate for variables such as external environment, temperature and humidity.

Figure 4:
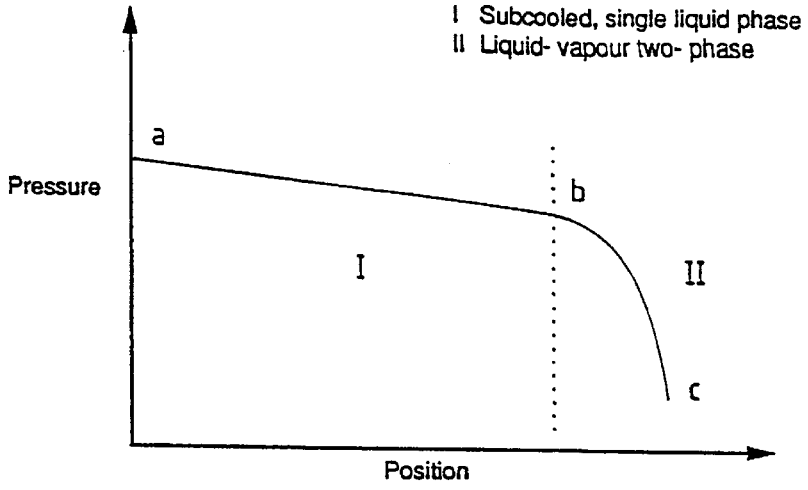
FIG. 4 is a diagram showing a generalised graph of refrigerant pressure versus position along the capillary tube.

The refrigerant flow rate in a capillary tube is dependent not only on its dimensions but also on the state of the refrigerant at the entrance of the capillary. As liquid refrigerant flows through a capillary tube from the outlet of a condenser at high pressure to the inlet of an evaporator at low pressure there will be a pressure gradient along the tube. With reference to FIG. 4, if the liquid is sub-cooled at the inlet 'a' it will lose pressure as it flows along the tube due to tube wall frictional losses.

At some position 'b' along the tube it will reach saturation pressure. Beyond this point flashing occurs as the refrigerant changes from the liquid state to the liquid vapour mixture. The pressure gradient increases rapidly due to both the effects of tube friction and the fluid acceleration as more liquid vaporises. At point 'c' choking occurs at the exit of the tube. At this critical condition, any reduction of the evaporator pressure downstream will have no effect on the mass flow rate.

Figure 5:
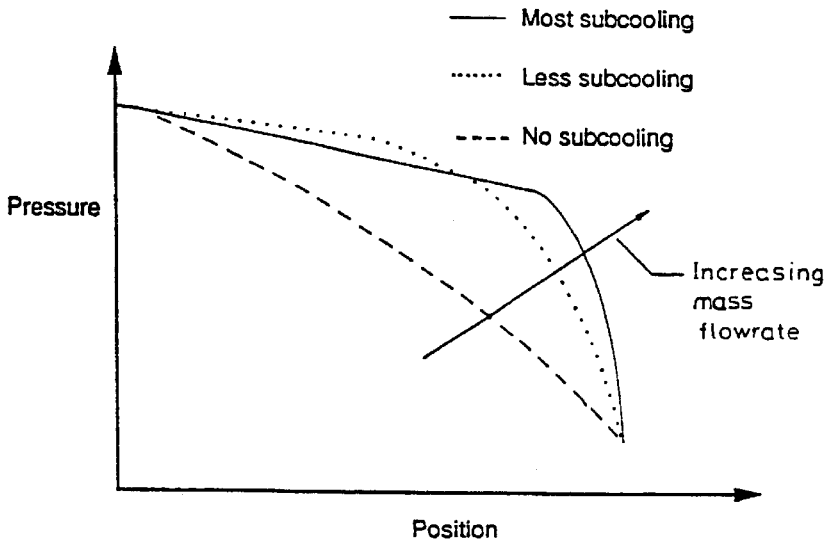
FIG. 5 is a diagram showing refrigerant pressure versus position along the capillary tube with varying degrees of refrigerant subcooling at the capillary inlet in accordance with the present invention.

As most of the pressure drop in the tube occurs in the region of the two-phase flow this is the region which effectively controls the flow rate. The greater the pressure gradient in this region, the greater the flow rate. Referring to FIG. 5, the pressure gradient is determined by the position of the saturation pressure. The position along the tube of the saturation point is dependent on the amount of sub-cooling of the liquid at the entry.

Figure 6:
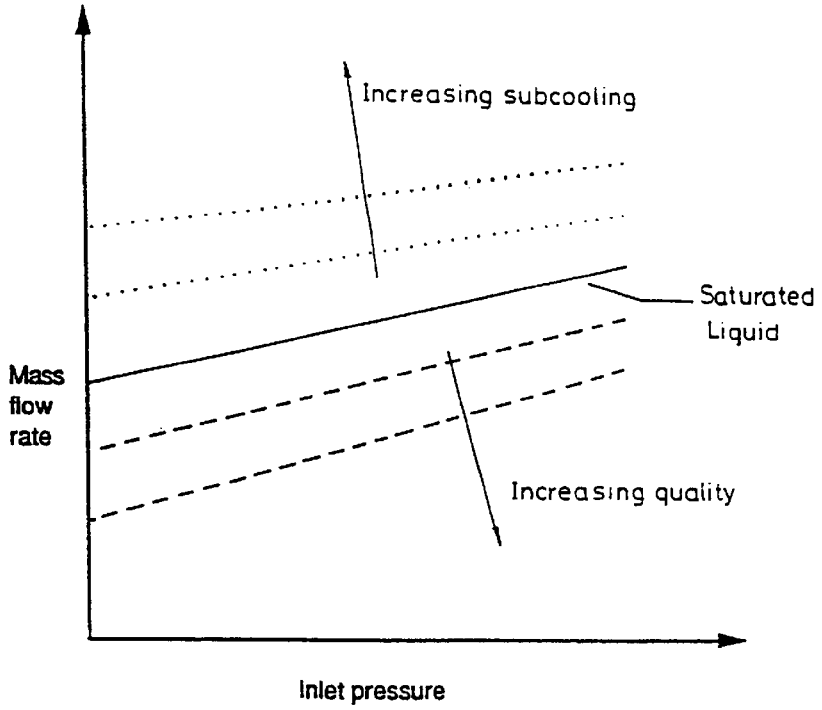
FIG. 6 is a diagram of mass flow rate versus capillary inlet pressure showing the effect of the degree of subcooling and the effect of refrigerant quality.

It follows that the mass flow rate is strongly influenced by the degree of sub-cooling. Similarly, if the refrigerant is not completely condensed in the condenser the flow rate is strongly influenced by the quality of the refrigerant at the entry to the tube. FIG. 6 illustrates this relationship.

Therefore with a controllably variable amount of sub-cooling applied at or near the entry of the capillary tube a variable flow control is created. The thermo-electric cooling module provides the variable sub-cooling of the refrigerant at or near the entry of the capillary tube.

FIG. 3 shows the representative refrigeration system incorporating thermo-electric sub-cooling flow control. In this case the module is added at the beginning of the capillary tube. This arrangement is convenient due to the ability to obtain good heat exchange between the thermo-electric module and a length of the small diameter capillary tube. In this system the refrigeration controller modulates the power to the variable capacity compressor, thereby varying its pumping rate. It can also control the amount of sub-cooling of the refrigerant by either switching or modulating the power applied to the thermo-electric module via the flow controller.

Many control strategies are available to people skilled in the art to match the flow capacity of the capillary tube to the compressor pumping rate for maximum system efficiency. One method is to measure evaporator superheat and modulate power to the thermo-electric module to ensure superheat is minimised. Alternatively, knowing the demanded pumping rate and knowing or inferring system parameters such as the evaporator temperature can be sufficient to infer the necessary power for the flow controller to supply to the thermo-electric module.

Figure 7:
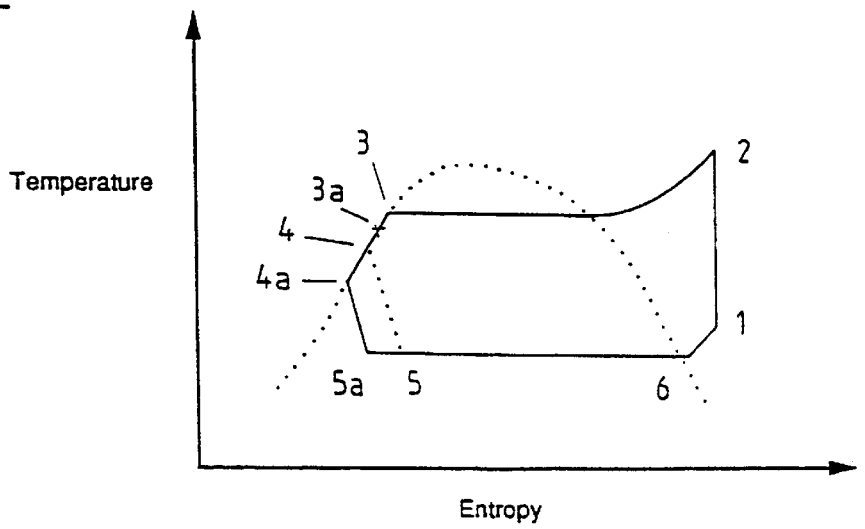
FIG. 7 is a temperature-entropy diagram of a vapour-compression refrigeration cycle such as performed by the system of FIG. 3.

In addition to the advantages already discussed, thermo-electric sub-cooling flow control also has the added advantage of increasing the refrigerating capacity of the system. The Temperature-Entropy diagram of FIG. 7 shows the refrigeration cycle of the system of FIG. 3 with and without thermo-electric sub-cooling with sub-cooling positioned at or before the entrance to the capillary for simplicity. The cycle 1-2-3-3*a*-4*a*-5*a*-6 with sub-cooling has a greater enthalpy of vaporisation 5*a*-6 than the enthalpy of vaporisation 5-6 of cycle 1-2-3-4-5-6 without sub-cooling. The efficiency of the system is improved, therefore for a given compressor capacity more heat is pumped.

Of course the invention need not be restricted to the use of variable capacity compressors. System efficiency can also be improved for refrigeration systems incorporating fixed capacity compressors.

Figure 8:
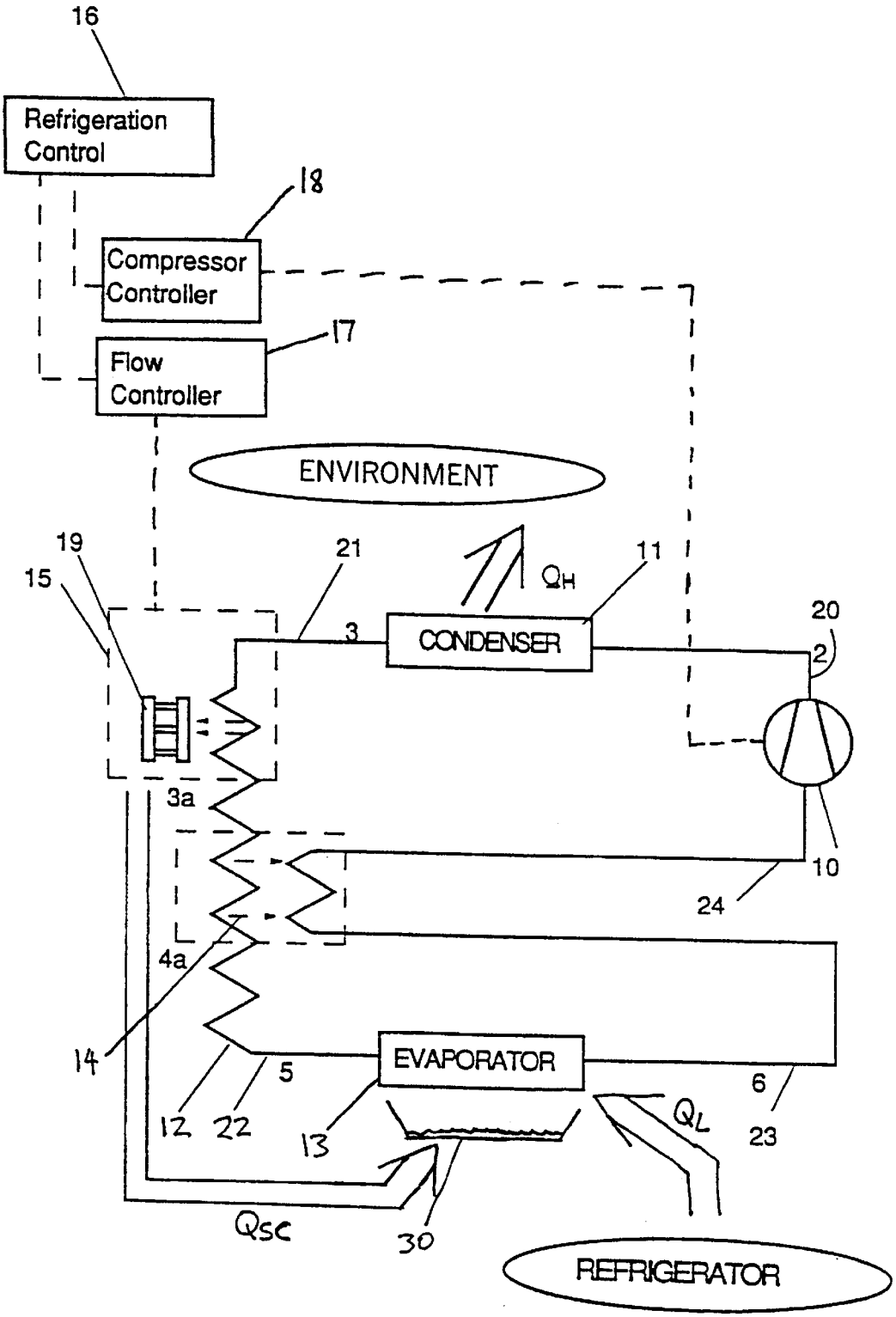
FIG. 8 is a schematic view of a vapour compression refrigeration cycle according to a variation on the preferred embodiment of the present invention.

A further variation on the present invention is depicted in FIG. 8. In this embodiment a condensation collector 30 is associated with the evaporator 13 to collect condensed water vapour which forms on the external surfaces of the evaporator during operation of the refrigeration system due to cooling of the air in which the water vapour was formerly entrained. During operation of the refrigeration system this condensation may of course be frozen on the outside of the evaporator 13, and subsequently discharged to the condensation collector 30 during a defrost operation. The defrost operation may for example comprise a period where the refrigeration system does not operate, or may involve a periodically energised heater associated with the evaporator to actively heat the outside thereof and melt any ice that has formed. In the system of FIG. 8 the operation of the variable sub-cooling means 15 is augmented by providing that the heat extracted from the refrigerant, rather than being passed to the environment generally, for example by air convection over cooling fins, is instead passed to any condensation which has collected in the condensation collector 30. While this is only demonstrated diagrammatically in FIG. 8, any number of different means may be provided to accomplish this heat transfer. As an example, the heat discharging faces of the thermo-electric elements of the preferred embodiment of the present invention could be disposed in contact with the underside of a condensation collection tray, the tray being formed from a reasonably heat conductive material such as sheet aluminium. The heat is thus conducted to the condensation via a path with relatively low thermal resistance, and the tray presents a large heat transfer area to the condensation. However other embodiments might include ducting condensation through the heat exchange fins of a thermo-electric element, or forming the tray and thermo-electric element as a nearly integral unit.

This further improvement as depicted diagrammatically in FIG. 8 clearly provides a double benefit. Not only does it augment the operation of the variable sub-cooling means by providing for more efficient, conductive heat discharge, but it also enhances the evaporation of the condensed water vapours from the collection tray so that in the normal operation of the refrigeration system manual emptying of the condensation collection tray will not be required.

I claim:

1. A refrigeration system comprising:

a compressor, a condenser, a flow control device, and an evaporator, all connected in refrigerant flow relation such that the refrigerant flows through the system to absorb heat at the evaporator, said control device comprising a capillary tube wherein in use refrigerant from said condenser enters said tube in a substantially liquid state and exits said tube in a mixed fluid/vapor state, there being a flash point in said tube at which said liquid begins to vaporize and variable sub-cooling means to provide additional forced cooling of the refrigerant at a region of or just prior to said capillary, said sub-cooling means variable to control the degree of said forced cooling of the refrigerant, and thereby the position along said capillary at which the refrigerant reaches saturation pressure; and active control means which actively control said variation of said variable sub-cooling means, wherein said compressor is variable speed to provide varying flow capacities depending on the circumstance and said control means varies said forced cooling such that the flow control provided by said variable sub-cooling means and said capillary matches said varied compressor.

2. A refrigeration system as claimed in claim 1 wherein said sub-cooling means comprises one or more thermal electric elements in intimate thermal connection with said capillary.

3. A refrigeration system as claimed in claim 1 including condensation collection means which are adapted to collect condensed water vapor from the exterior of said evaporator, including condensed water vapor which may in use freeze on the exterior surface of said evaporator and be thawed during a defrosting process, said variable sub-cooling mans configured to in use discharge some or all of the heat drawn form the refrigerant to such collected condensation as is present in said condensation collection mans.

4. A refrigerator incorporating a refrigeration system in accordance with claim 1.

5. A refrigeration system comprising:

a compressor, a condenser, a flow control device, and an evaporator, all connected in refrigerant flow relation such that the refrigerant flows through the system to absorb heat at ate evaporator, said flow control device comprising a capillary tube wherein in use refrigerant from said condenser enters said tube in a substantially liquid state and exits said tube in a mixed fluid/vapor state, there being a flash point in said tube at which said liquid to vaporize, and variable sub-cooling means to provide additional forced cooling of the refrigerant at a region of or just prior to said capillary, said sub-cooling means variable to control the degree of said forced cooling of the refrigerant, and thereby the position along said capillary at which the refrigerant reaches saturation pressure; and active control means which actively control said variation said of variable sub-cooling means, wherein said sub-cooling means comprises one or more thermoelectric elements in intimate thermal connection with said capillary.

6. A refrigerator incorporating a refrigeration system in accordance with claim 5.

7. A refrigeration system as claimed in claim 5 including a condensation collection means which is adapted to collect condensed water vapor from the exterior surface of said evaporator, including condensed water vapor which may in operation of the refrigeration system condense on and freeze on the exterior surface of said evaporator and be thawed during a defrosting process, and at least one said thermoelectric element has the heat discharge surface thereof positioned to in use conduct heat to such condensed water as may have collected in said condensation collection means.

8. A refrigeration system comprising:

a compressor, a condenser, a flow control device, and an evaporator, all connected in refrigerant flow relation such that the refrigerant flows through the system to absorb heat at the evaporator, said flow control device comprising a capillary tube wherein in use refrigerant from said condenser enters said tube in a substantially liquid state and exits said tube in a mixed fluid/vapor state, there being a flash point in said tube at which said liquid begins to vaporize and, variable sub-cooling means to provide additional forced cooling of the refrigerant at a region of or just prior to said capillary, said sub-cooling means variable to control the degree of said forced cooling of the refrigerant, and thereby the position along said capillary at which the refrigerant reaches saturation pressure; active control means which actively control said variation of said variable sub-cooling means and condensation collection means which are adapted to collect condensed water vapor from the exterior of said evaporator, including condensed water vapor which may in use freeze on the exterior surface of said evaporator and be thawed during a defrosting process, said variable sub-cooling means configured to in use discharge some or all of the heat drawn from the refrigerant to such collected condensation as is present in said condensation collection means.

9. A refrigerator incorporating a refrigeration system in accordance with claim 8.

10. A method of refrigerating comprising passing a refrigerant through a refrigeration system including a condenser, a capillary flow control device and an evaporator connected in refrigerant flow relation to absorb heat at said evaporator and give off heat at said condenser, which method includes the steps of assessing one or more one or more environmental or usage factors affecting the performance of said refrigeration system and sub-cooling said refrigerant at the entry to or along the length of said capillary flow control device to a degree varied according to said assessed factor or factor of collecting condensed water vapor which may from time to time condense on the exterior surface of said evaporator and discharging heat extracted from said refrigerant during said sub-cooling to said collected condensation.

11. A refrigerator adapted to preform the method in accordance with claim 10.

* * * * *